US005951316A

United States Patent [19]

Kawano et al.

[11] Patent Number: 5,951,316

[45] Date of Patent: Sep. 14, 1999

[54] CONNECTOR

[75] Inventors: Kyoichiro Kawano; Kohji Hanada, both of Kawasaki, Japan; C. Timothy Norman, San Jose, Calif.

[73] Assignees: Fujitsu Limited, Kanagawa, Japan; Amadhl Corp., Sunnyvale, Calif.

[21] Appl. No.: 08/897,631

[22] Filed: Jul. 21, 1997

Related U.S. Application Data

[63] Continuation of application No. 08/722,884, Sep. 26, 1996, abandoned, which is a continuation of application No. 08/522,834, Sep. 1, 1995, abandoned, which is a continuation of application No. 08/160,255, Dec. 2, 1993, abandoned.

[30] Foreign Application Priority Data

Dec. 7, 1992 [JP] Japan ..... 4-326874

[51] Int. Cl.[6] ..... H01R 13/627

[52] U.S. Cl. ..... 439/352; 439/357

[58] Field of Search ..... 439/350, 352, 439/353, 355, 357, 358, 488, 489, 607, 610

[56] References Cited

U.S. PATENT DOCUMENTS

| | | | |
|---|---|---|---|
| 4,548,455 | 10/1985 | Ezure | 439/352 |
| 4,634,204 | 1/1987 | Detter et al. | 439/352 |
| 4,708,413 | 11/1987 | Schroeder | 439/352 |
| 4,787,860 | 11/1988 | Bender | 439/358 |
| 4,929,189 | 5/1990 | Sekiguchi | 439/352 |
| 4,954,097 | 9/1990 | Sekiguchi | 439/352 |
| 5,234,356 | 8/1993 | Maejima et al. | 439/352 |
| 5,338,227 | 8/1994 | Nakamura | 439/352 |

FOREIGN PATENT DOCUMENTS

| | | |
|---|---|---|
| 1113976 | 7/1989 | Japan . |
| 1113977 | 7/1989 | Japan . |
| 1113980 | 7/1989 | Japan . |

*Primary Examiner*—Hien Vu

*Attorney, Agent, or Firm*—Armstrong, Westerman, Hattori, McLeland & Naughton

[57] ABSTRACT

A stopper mechanism includes: an arm part which is a part of a cover; an arc-like projection part at the end of the arm part; and a sliding member slidably provided in the cover. When the sliding member flanks the projection part, the arm part is prevented thereby from being bent and a stopper mechanism is locked. When the sliding member is allowed to slide and to be removed from behind the projection part, the arm part is allowed to be bent, and the stopper mechanism is unlocked.

2 Claims, 15 Drawing Sheets

CONNECTOR

This application is a continuation of application Ser. No. 08/722,884 filed Sep. 26, 1996, now abandoned; which is a continuation of application Ser. No. 08/522,834 filed Sep. 1, 1995, now abandoned; which is a Continuation of application Ser. No. 08/160,255 filed Dec. 2, 1993, now abandoned.

BACKGROUND OF THE INVENTION

The present invention relates to a connector, and more particularly to a connector connected to a motherboard of a large scale computer.

The configuration of a motherboard in a large scale computer is as shown in FIG. 1.

Numeral 1 indicates a motherboard.

A printed board 3 on which LSI's 2 are mounted is mounted on the underside of the motherboard 1 by means of a connector 4.

The motherboard 1 is fitted to a computer body frame 7 by means of a mounting frame 5 and a piece of metal fittings 6.

Numeral 8 indicates a ground frame fitted to the frame 7 by means of a connecting means 9 and provided across and separated from the surface of the motherboard 1, on which surface a printed board 3 is mounted.

A number of pins 9 corresponding to the LSI's 2 are provided so as to stand on the surface of the motherboard 1 facing the ground frame 8.

Numeral 10 indicates a metal connector guide having a grid-like structure as shown in FIG. 2. The connector guide is fitted to the surface of the motherboard 1 facing the ground frame 8 and connected to the metal fittings 6.

Numeral 11 indicates a connection part arranged in a matrix. A predetermined number of pins 9 are provided in the connection part 11. This way, the pins 9 are divided into blocks of a predetermined number of pins.

As shown in FIG. 1, a connector 13 at the end of a cable 12 is plugged into the respective connection part 11.

This way, a matrix results in which the connectors 13 are very closely arranged lengthwise and breadthwise.

The other end of the cable 12 is connected to another unit (not shown).

Recently, with an increase in processing speed of large computers, motherboards have become miniaturized.

This has resulted in the reduction of pitches utilized in the connector mounting operation. Now, miniaturization of the connector itself is desired.

It is also to be noted that the number of pins 9 has been increasing with improvement of the function of the large scale computer. Accordingly, the cable diameter tends to be larger. Thus, a stopper means incorporated into the connector also needs to be made smaller.

FIG. 3 shows a conventional connector 20 described in the Japanese Laid-Open Patent Application 1-113977.

Numeral 21 indicates a connector main body, and 22 a cable.

A latch lever 23 is built into the connector main body 21.

The latch lever 23 comprises a hook part 23*a* at one end thereof and a handle part 23*b* at the other end thereof, and is pivotally supported near the center thereof by means of a pin 24.

The connector 20 is guided by the connector guide 10 so as to be plugged into the connection part 11. The hook part 23*a* engages an engaging part 25 in the connection part 11 so that the connector is prevented from being pulled.

The latch lever 23 is built into a space 26 delineated by the cable 22 and the sides of the connector main body 21.

The latch lever 23 is formed by bending a sheet metal in a complicated manner; the size of the latch lever is relatively large.

Thus, a relatively large (about 10 mm) depth A in the above-mentioned space 26 results.

This means a relatively large (about 20 mm) width B of the connector 20.

A diameter C of the cable 22 is about 6 mm.

Predictably, the width of the connector will become larger as the diameter of the cable increases with expansion of the functions of large scale computers.

SUMMARY OF THE INVENTION

Accordingly, the object of the present invention is to provide a connector in which the stopper means is made thin so that miniaturization of the connector is achieved.

According to claim 1, the present invention involves: a connector provided at the end of a cable and comprising a stopper means, wherein the stopper means comprises:

- a resilient arm part provided in a connector main body;
- a round projection part provided at the end of the arm part and engaged with an engaging part of a connector of a computer unit; and
- a sliding member slidably provided in the connector main body so as to normally flank the arm part and so as to prevent the projection part from being displaced in such a direction as to cause the projection part to be removed from the engaging part, the sliding member being pulled when the connector is to be pulled out of the connector of the computer unit, so as to be removed from a position where the sliding member flanks the arm part and so as to allow the arm part to be displaced in the above-mentioned direction.

According to claim 2, the connector of the present invention is configured such that the arm part is formed as a part of a cover constituting the connector main body.

According to claim 3, the connector of the present invention further comprises a stopper mechanism for restricting the movement of the sliding member as the sliding member is being pulled, the restriction being effected by the stopper mechanism coming in contact with a part of the connector main body.

The configuration of claim 1 which includes the arm part, the projection part, and the sliding member serves to make the stopper means thin.

The configuration of claim 2 in which the arm part is formed as a part of the cover serves, as compared to the configuration in which the arm part is provided as a member separate from the cover and is fitted on the cover, not only to make the separate arm part unnecessary but to make the stopper means thinner.

The configuration of claim 3 in which the stopper mechanism is provided functions such that the stopper mechanism exerts, when the sliding member is being pulled, a force pulling the connector main body from the connector of the computer unit.

Other objects and further features of the present invention will be apparent from the following detailed description when read in conjunction with the accompanying drawings.

DESCRIPTION OF THE PREFERRED EMBODIMENTS

FIGS. 4 through 7 show a connector 30 of the first embodiment.

Figure 7:
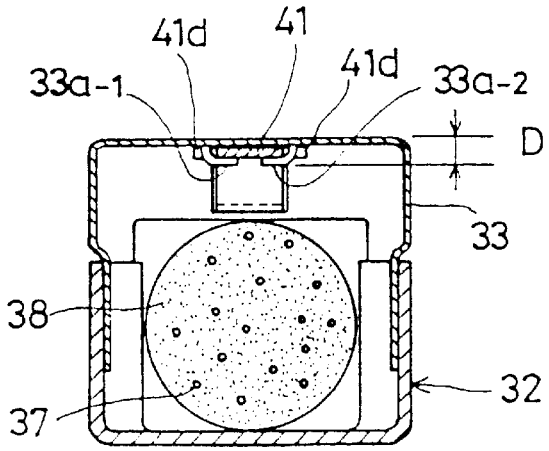
FIG. 7 is a cross-sectional view taken along the line IV—IV of FIG. 6.

A connector main body 31 is constructed of a combination of a metal sheet first cover half-body 32 and of a metal sheet second cover half-body 33, as shown in FIG. 7, the cross-section of the connector main body having a substantially rectangular shape.

A resin block 35 in which female contacts 34 are embedded is secured at the end of the connector main body 31.

The connector 30 is connected to the end of a cable 36 such that the end of the cable 36 is clamped to the back end of the connector main body 31.

An electric wire 37 drawn out of the end of the cable 36 is soldered to each of the female contacts 34, the soldered part being encapsulated and reinforced with a resin 38.

The second cover half-body 33 has a bulge part 33*a*, the connector main body 31 being divided into a large-proportion part 31A and a small-proportion part 31B for convenience's sake.

The cable 36 is drawn out of the small-proportion part 31B of the connector main body 31 and pulled to a side of the connector 31.

A stopper mechanism 40 is built into the part of the large-proportion part 31A, which part forms the bulge part 33.

The stopper mechanism 40 generally comprises an arm part 33*b*, a projection part 33*c* and a sliding member 41.

The second cover half-body 33 is made of a thin plate. The arm part 33*b* is embodied by a part of the second cover half-body 33 and is formed to extend toward the end of the connector 30. The arm part 33*b* is elastically deformable in a direction $Z_1$–$Z_2$ indicated by arrows, in other words, in a direction perpendicular to a side 31*a* of the connector main body 31.

The sliding member 41 is a long and narrow piece and is held so as to contact the inside of the second cover half-body 33 by means of two louvered parts 33*d* and 33*e* formed on the second cover half-body 33.

The louvered parts 33*d* and 33*e* are configured such that a pair of louvered pieces $\mathbf{33}d_{-1}$ and $\mathbf{33}d_{-2}$ face each other, and another pair of louvered pieces $\mathbf{33}e_{-1}$ and $\mathbf{33}e_{-2}$ face each other.

This way, the sliding member 41 is guided by the louvered parts 33*d* and 33*e* so as to be slidable in the longitudinal direction of the connector 31.

A shallow depression 35*a* for accommodating the arm part 33*b* and the sliding member 41 is formed on a side of the block 35.

An end 41*a* of the sliding member 41 is guided into the depression 35*a* so as to lie behind the arm part 33*b*.

The other end 41*b* of the sliding member 41 projects out of the connector main body 31 through an opening 33*f* provided in the bulge part 33*a*, a ring 41*c* for grasping and manipulating the sliding member, being formed outside the opening. The ring 41*c* resides in a space 43 formed by an extension of the side 31*a* and the small-proportion part 31B.

Figure 13:
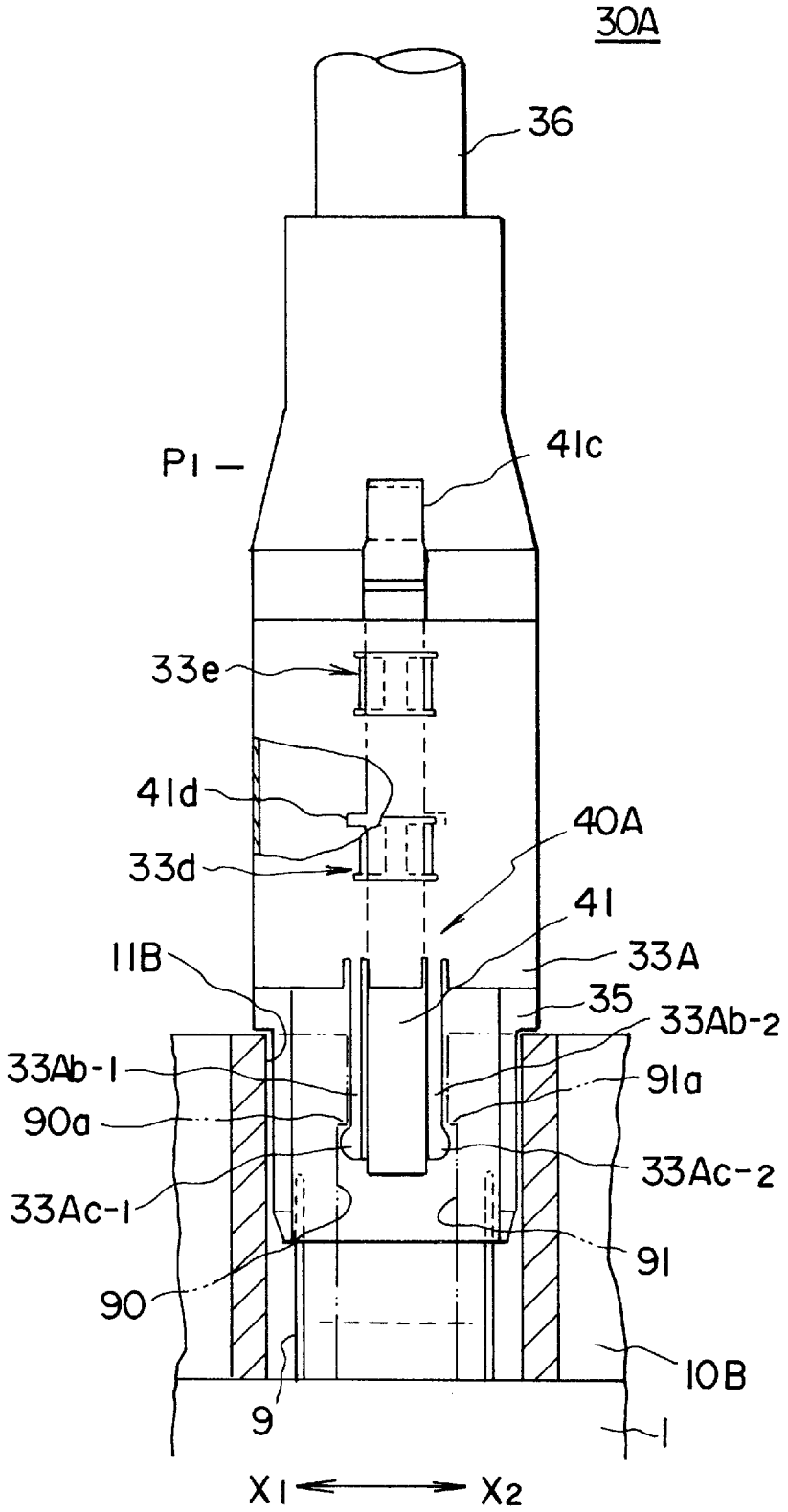
FIG. 13 shows another embodiment of the connector of the present invention.

Projections 41*d* are provided so as to extend breadthways and so as to project as extensions from the lateral edges of the middle part of the sliding member 41 (see FIG. 13).

Figure 5:
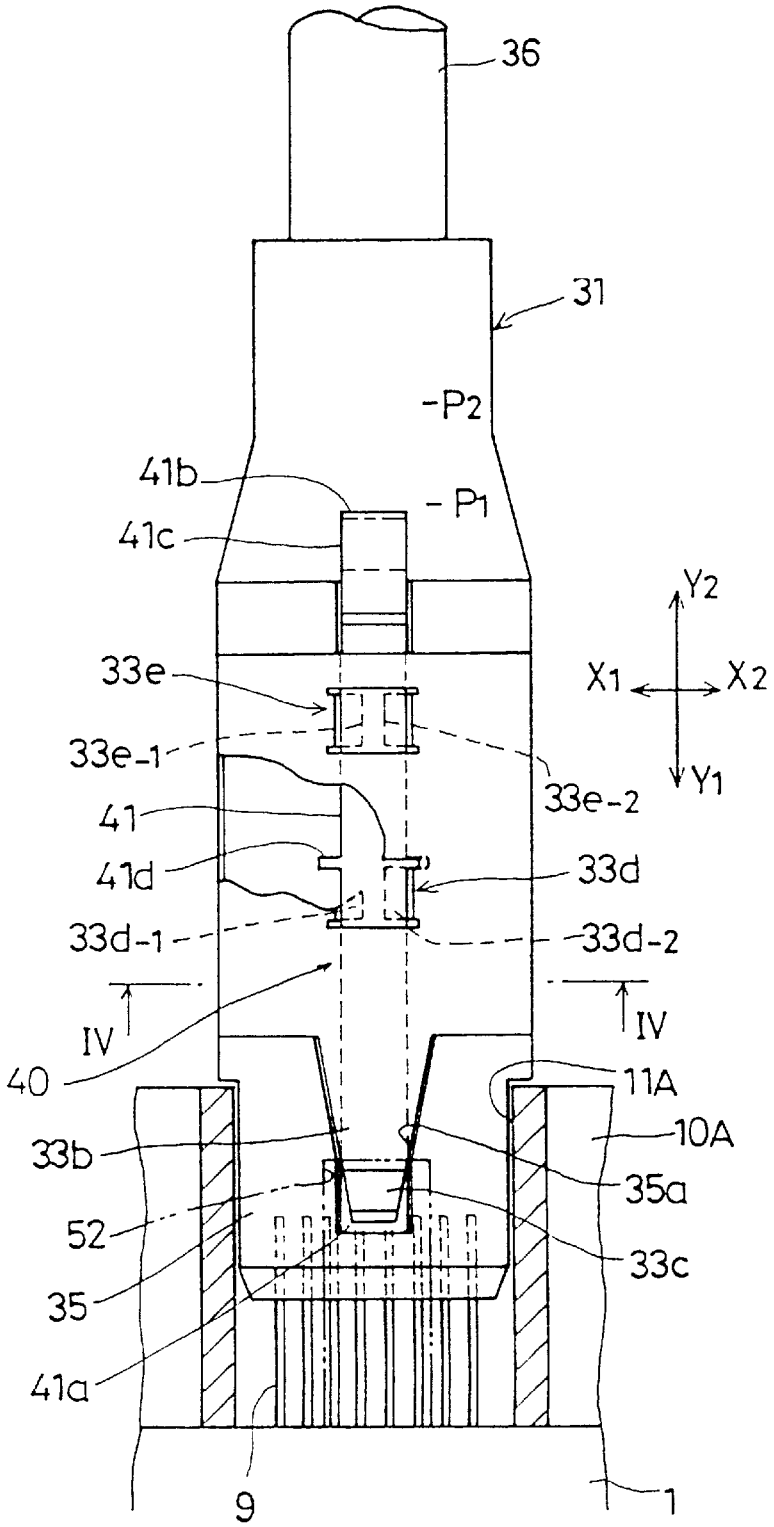
FIG. 5 is a front, partially broken away, view of the connector of FIG. 4.
Figure 9:
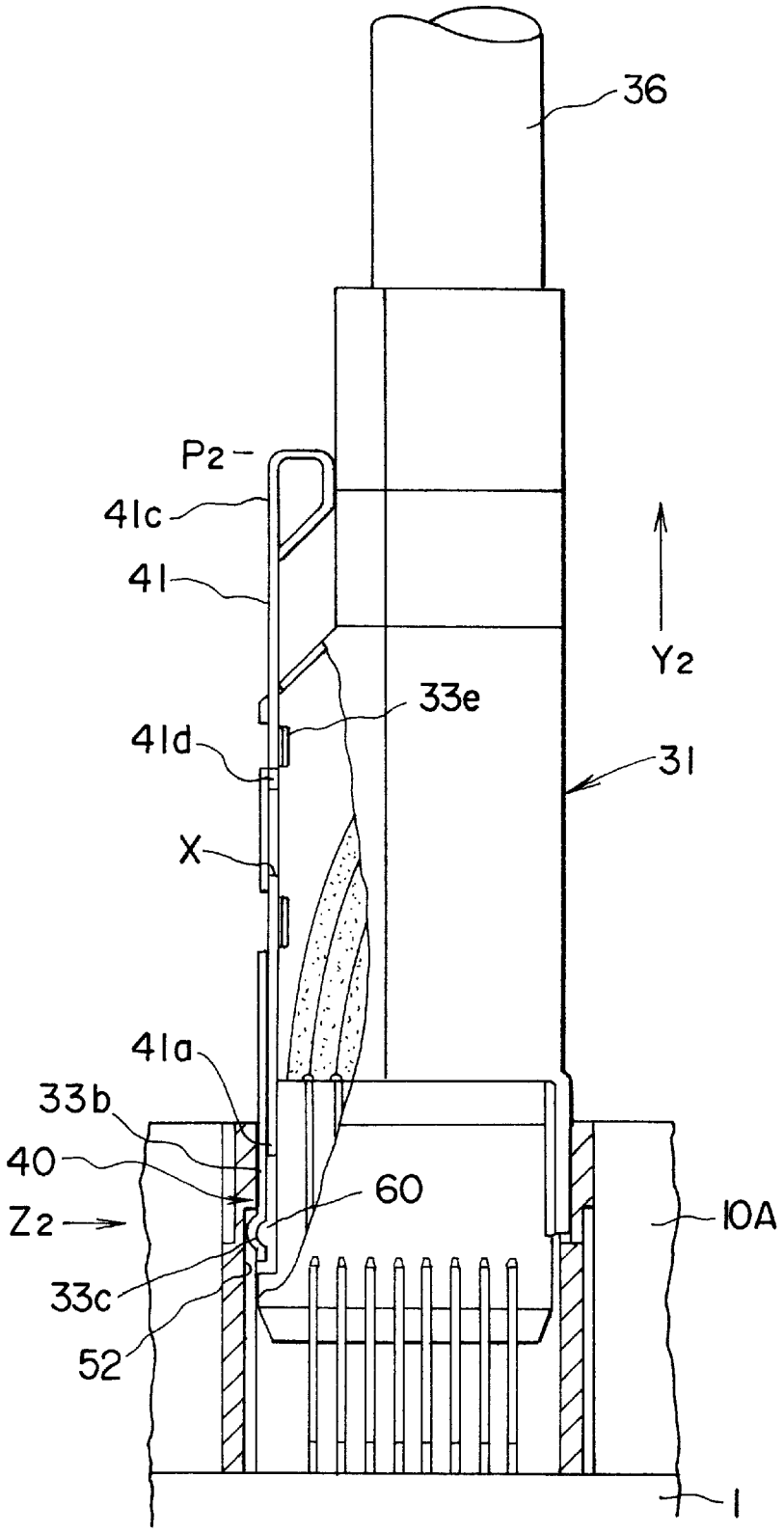
FIG. 9 shows a first step of pulling out a connector.

The sliding member 41 is caused to slide between a $P_1$ position at which the projection 41*d* is in contact with the louvered part 33*d* functioning as a stopper or slide limit mechanism, as shown in FIG. 5, and a $P_2$ position at which the projection 41*d* is in contact with the other louvered part 33*e* also functioning as a stopper, as shown in FIG. 9.

The projection 41*d* and the louvered part 33*e* constitute the slide limit mechanism.

The projection part 33*c* has an arc-like cross-section and is formed at the end of the arm part 33*a*.

The stopper mechanism 40 is configured such that the arm part 33*b* lies upon the sliding member 41, and occupies a depth D if the ring 41*c* is excluded from the measurement. The dimension D is as small as 1 mm.

Hence, a dimension E of the space 43 is as small as several milimeters.

As a result, despite an increase of 2 mm in a diameter $C_1$ of the cable 36 (having the diameter of 8 mm), a width $B_1$ of the connector 30 is reduced to about 14 mm, which means a reduction of about 6 mm from the conventional connector.

Figure 8:
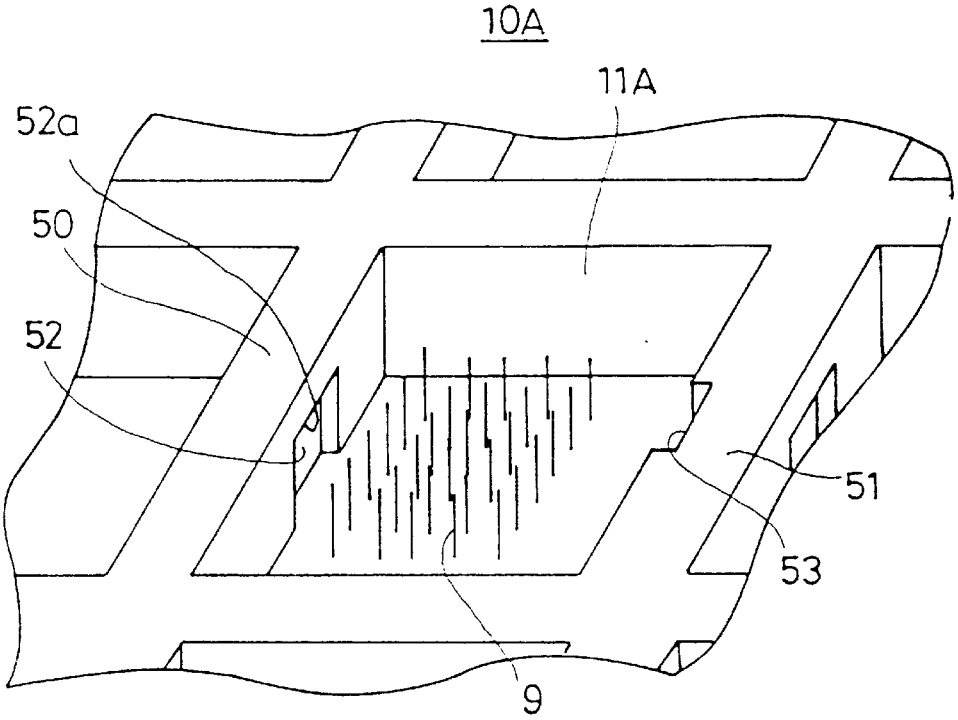
FIG. 8 shows the connector guide of FIG. 4.

The connector guide 10A provided on the motherboard 1 to correspond to the connector 30 of the above configuration has a configuration as shown in FIG. 8.

A connection part 11A serving as a connector of a computer unit has a predetermined number of pins 9. A wall 50, which is one of two opposing walls 50 and 51, is provided with a recess part 52 which serves as an engaging part. The wall 51 is provided with a notch 53 for preventing the connector from being inserted in an incorrect manner.

A description will now be given of how the connector 30 is connected and pulled out.

Figure 1:
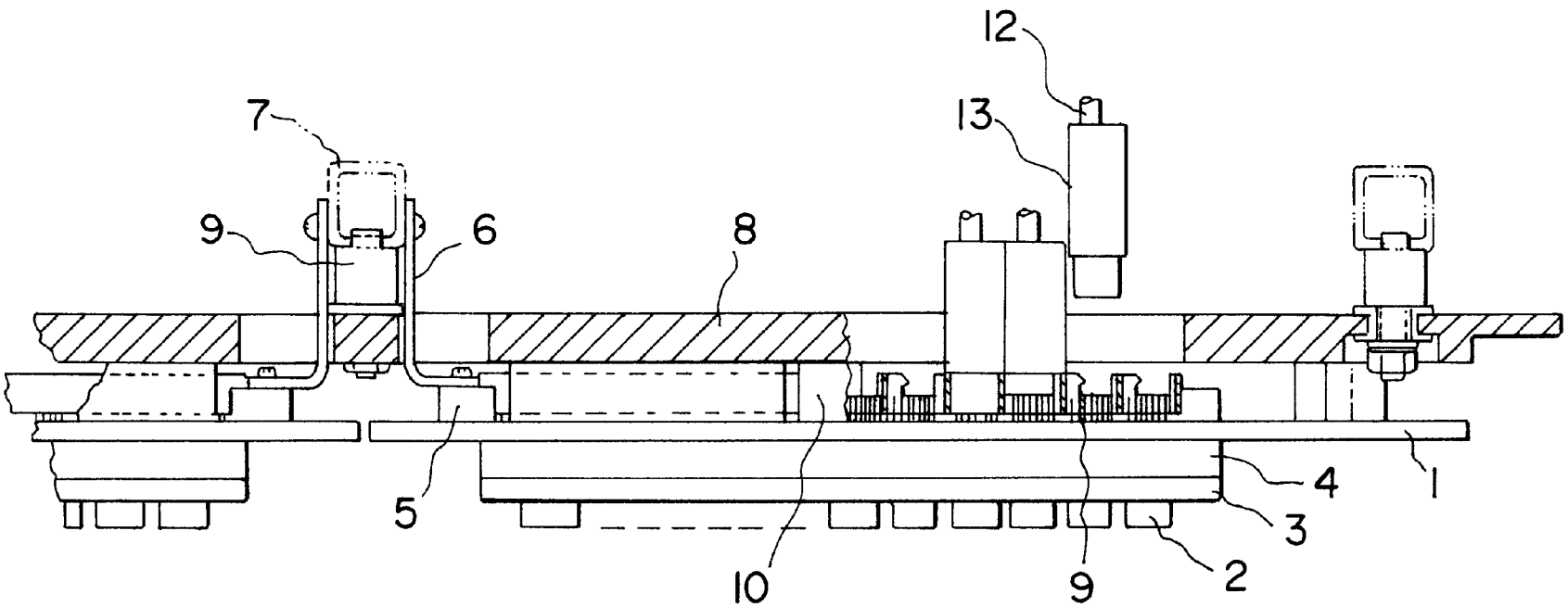
FIG. 1 shows a motherboard of a large scale computer.
Figure 2:
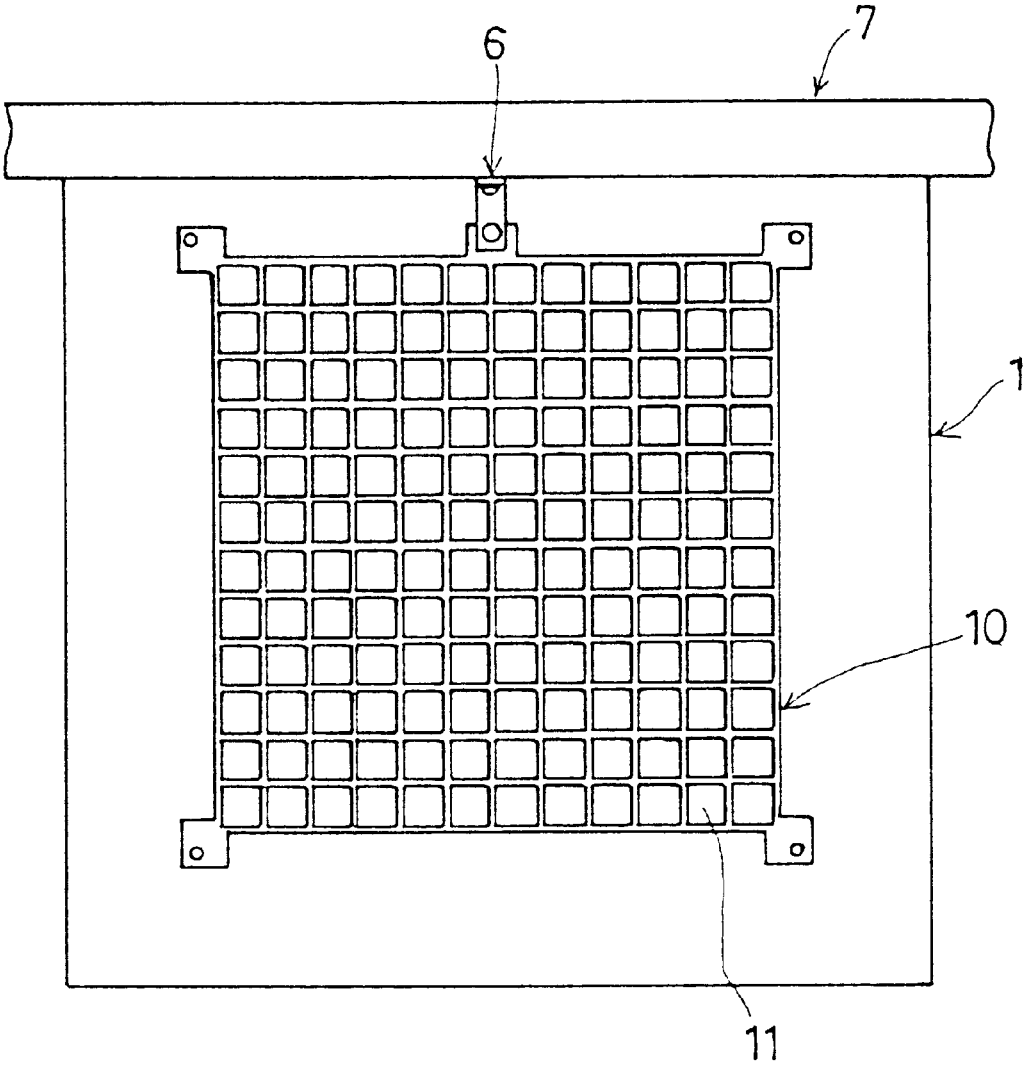
FIG. 2 is a top view of a connector guide of FIG. 1.
Figure 3:
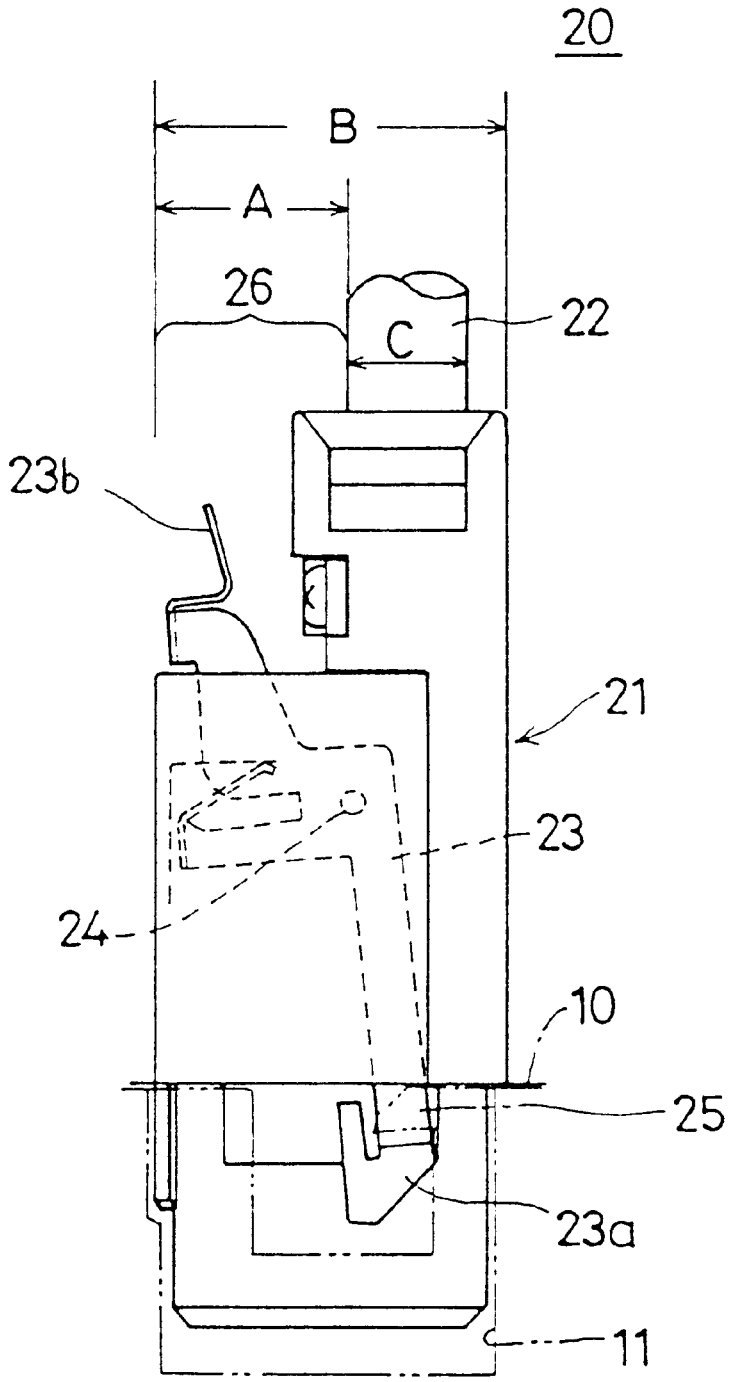
FIG. 3 shows an example of a conventional connector.
Figure 4:
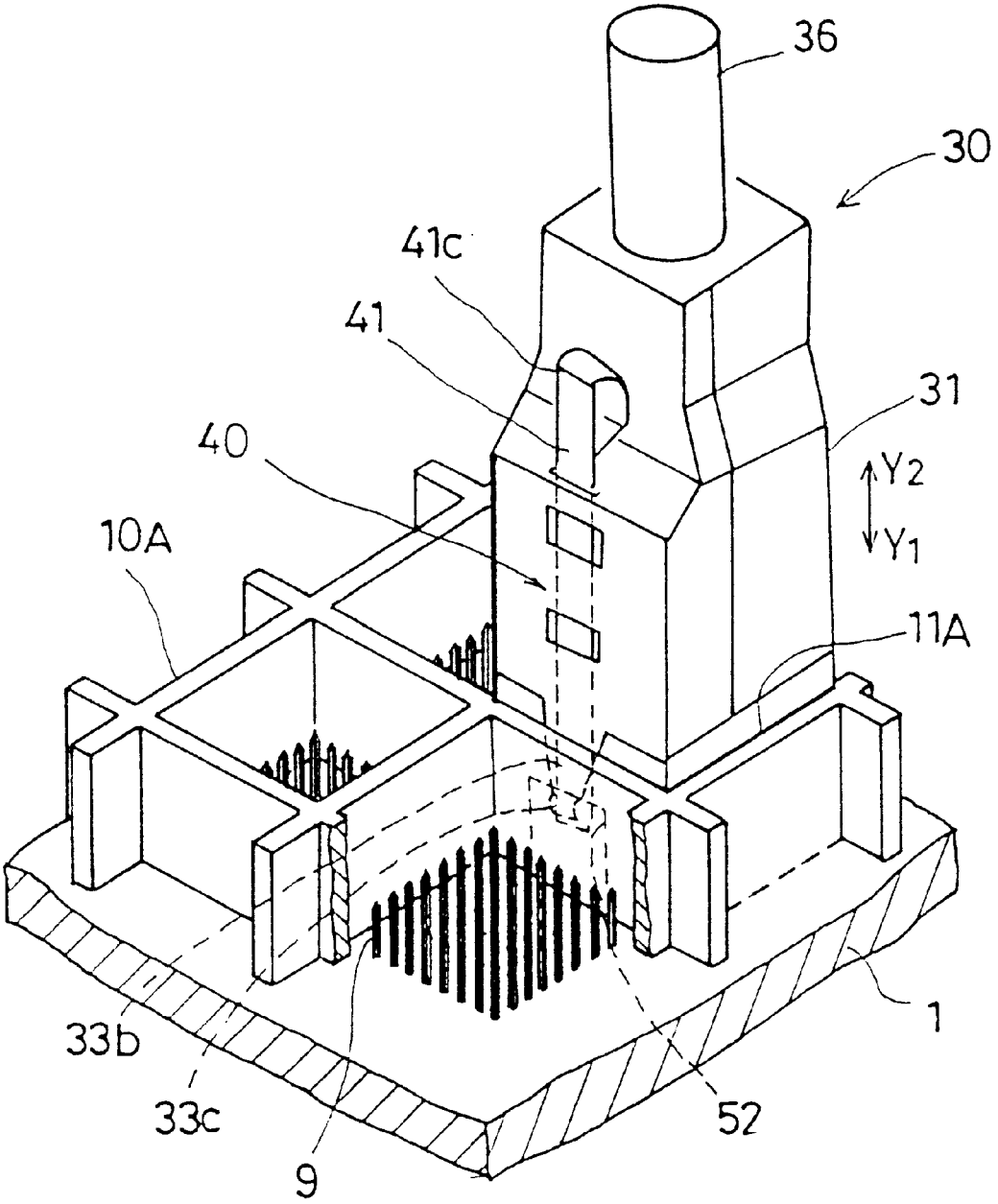
FIG. 4 is a perspective view showing how the connector of a first embodiment of the present invention is connected.
Figure 6:
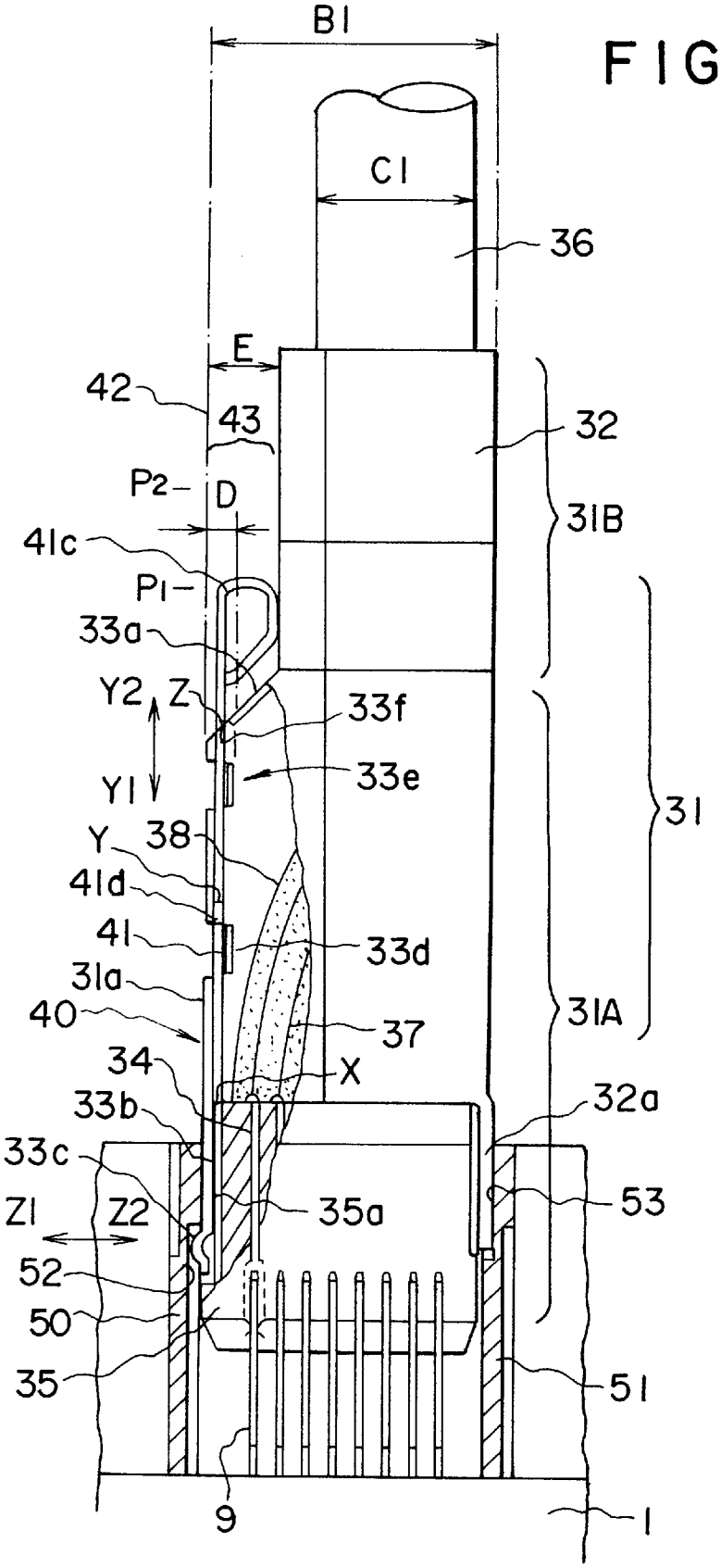
FIG. 6 is a side, partially broken away, view of the connector of FIG. 4.

As shown in FIGS. 4 through 6, the block 35 of the connector 30 is inserted into the connection part 11A; the female contacts 34 are coupled to the pins 9; a key 32*a* for preventing the connector from being inserted in an incorrect manner is engaged with the notch 53; the projection 33*c* is engaged with the recess part 52; and the sliding member 41, which has been slid in a direction $Y_1$, is joined to the connection part 11A which serves as a connector of the computer unit.

Figure 11:
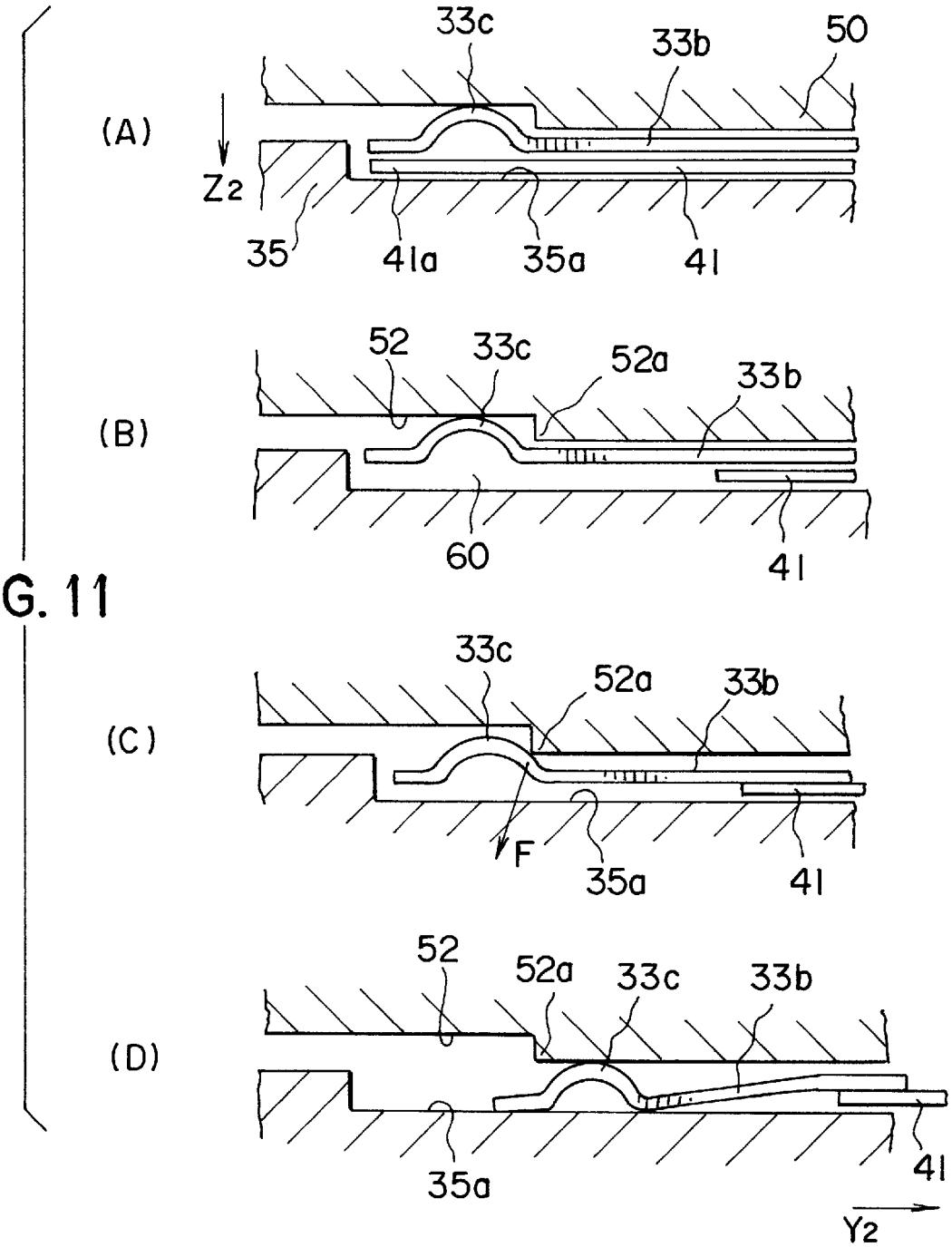
FIGS. 11A–11D show a lock releasing operation of a stopper mechanism.
Figure 12:
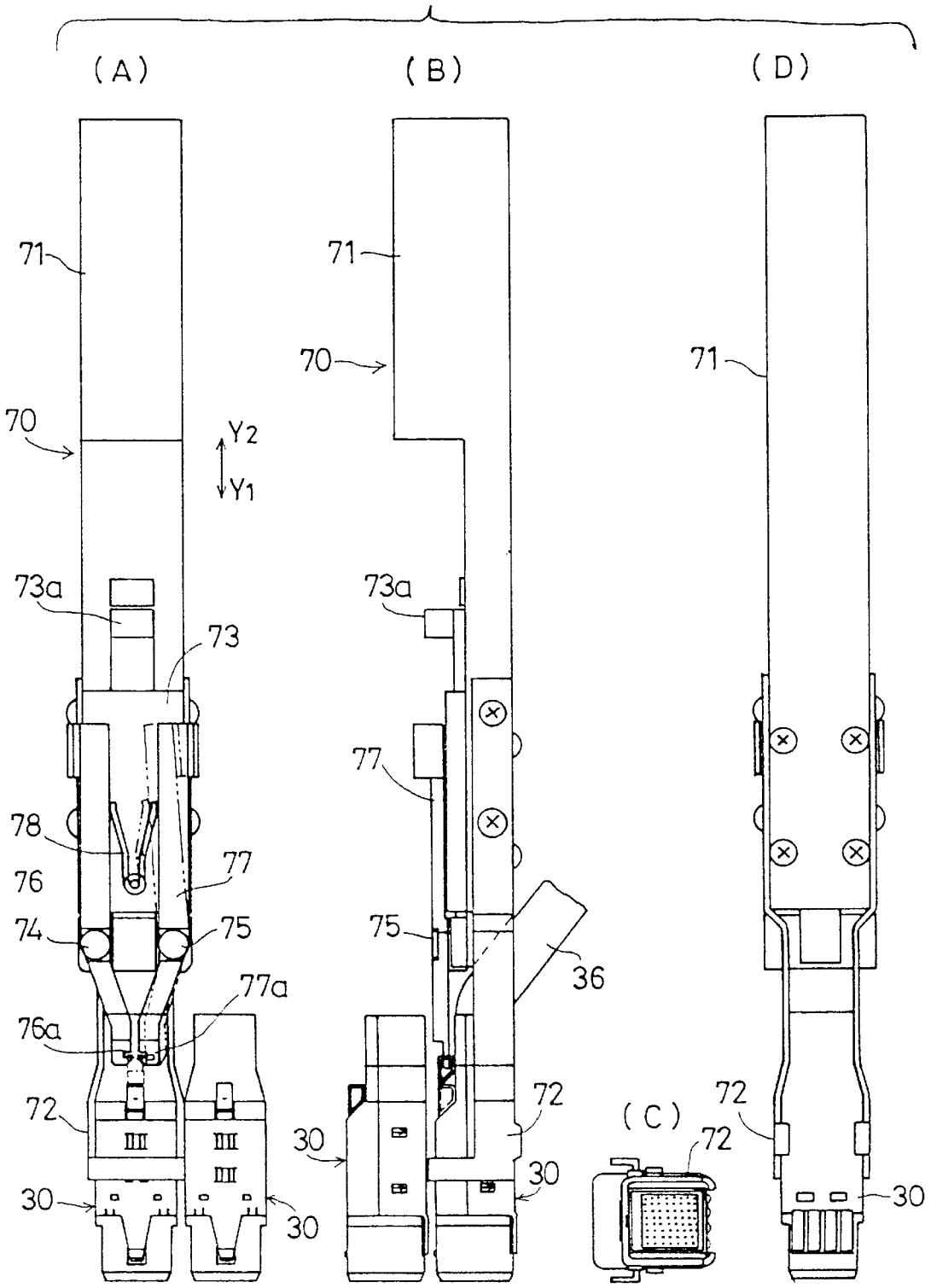
FIGS. 12A–12D show a jig used for pulling and connecting a connector.

As is also shown in FIG. 11(A), the sliding member 41 is slipped behind the arm part 33*b* so that the arm part 33*a* is prevented from being displaced in the $Z_2$ direction, in other words, in a direction in which the projection part 33*c* can be pulled out of the recess part 52. The stopper mechanism 40 is thus locked, and the connector 30 cannot be pulled out.

(1) Pulling-out operation

The sliding member 41 is pulled in the $Y_2$ direction, in other words, in the same direction as the connector 30 is pulled out of the connection part 11A.

First step (FIGS. 9 and 11(B))

The sliding member 41 moves in the $Y_2$ direction independently of the connector 31. The end 41*a* of the sliding member 41 is removed from behind the projection 33*c*; and a space 60 is created below the end part of the arm part 33*b*, the bottom of the space 60 being limited by the depression part 35*a*. The arm part 33*b* is now free to be displaced in the $Z_2$ direction.

This way, the stopper mechanism 40 is unlocked.

The projection part 41*d* is now in contact with the louvered part 33*e*.

Figure 10:
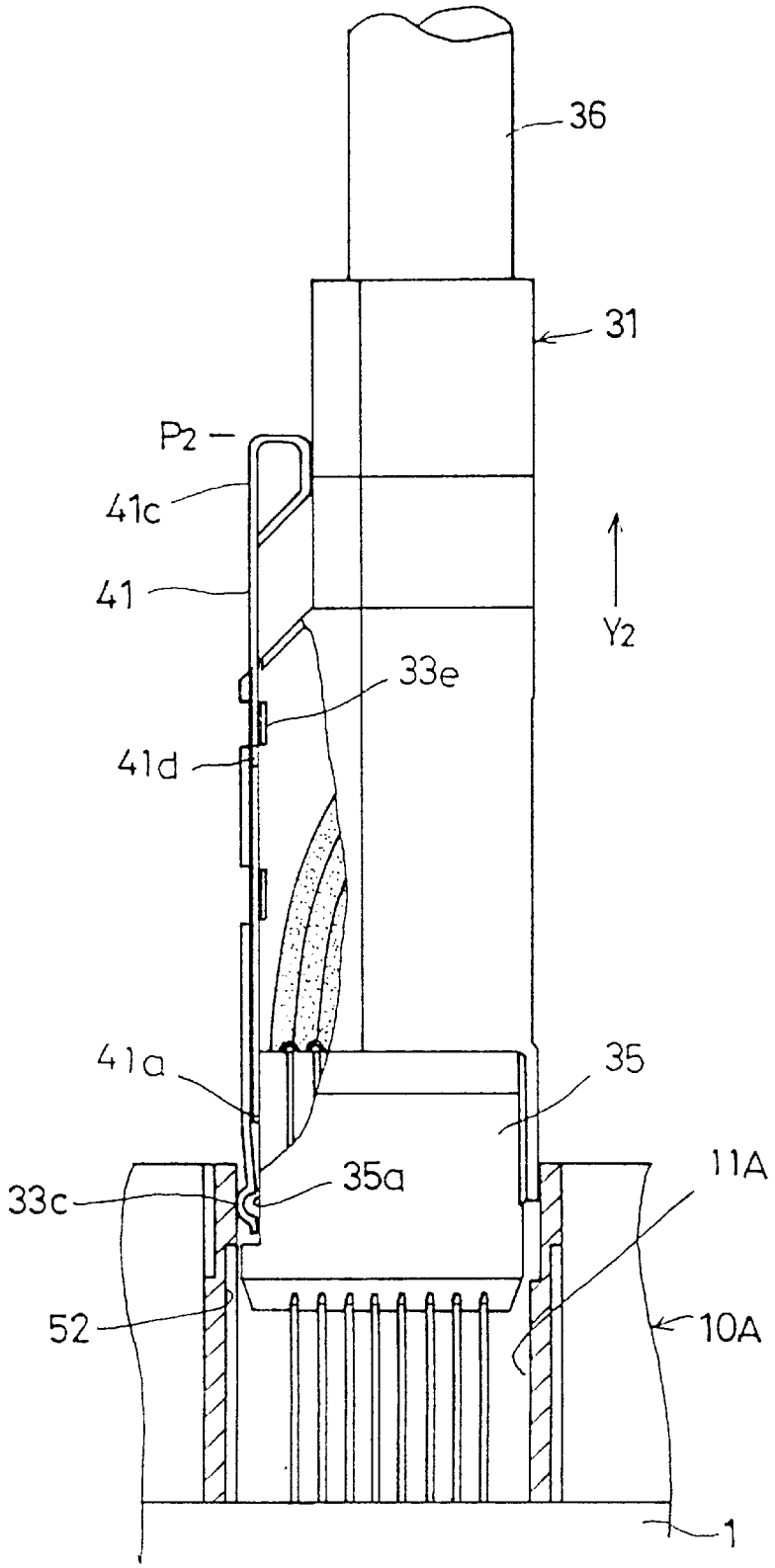
FIG. 10 shows a second step of pulling out a connector.

Second step (FIGS. 10 and 11(C))

When the projection part 41*d* comes in contact with the louvered part 3*e*, a force pulling the sliding member 41 in the $Y_2$ direction is transmitted to the connector main body 31, with the result that a force is exerted upon the connector main body 31 in the $Y_2$ direction and the connector 31 starts to be displaced in the $Y_2$ direction.

When the connector 31 starts to be displaced, the projection part 33*c* having an arc-like cross-section comes in contact with a shoulder part 52*a* at the edge of the recess part 52, as shown in FIG. 11(C).

Since the projection part 33*c* has an arc-like cross-section, a force F acts upon the projection part 33*c* in the $Z_2$ direction.

The space 60 is provided behind the projection part 33*c*.

Therefore, the arm part 33*b* bends in the $Z_2$ direction and the projection part 33*c* is gradually pulled out of the recess part 52 until the projection part 33*c* is completely pulled out of the recess part 52, lies upon the shoulder part 52*a* and becomes accommodated in the depression part 35*a*.

Accordingly, the connector main body 31 and the sliding member 41 are moved as one in the $Y_2$ direction until the connector 30 is pulled out of the connection part 11A.

(2) Connecting operation

The connector 30 is inserted into the connection part 11A of the computer unit, while the sliding member 41 lies in the $P_1$ position; in other words while the stopper mechanism 40 is unlocked.

The arm part 33*b* bends so that the projection part 33*c* having an arc-like cross-section is allowed to enter the connection part 11A.

When the connector 30 is inserted into the connection part 11A until it comes to a terminal position, the projection part 33*c* becomes directly opposite the recess part 52. The arm part 33*b* is then allowed to return to its original shape, and the projection part 33*c* is accommodated in the recess part 52.

This way, the connector 30 is in plug-in connection with the connection part 11A.

The sliding member 41 is then caused to slide in the $Y_1$ direction until it reaches the $P_1$ position.

Consequently, the sliding member 41 is slipped behind the projection part 33*c*, and the stopper mechanism 40 is locked.

A description will now be given of a jig used in the above pulling-out operation and in the connecting operation.

The above described pulling-out operation and connecting operation are carried out with the use of a rod-like jig 70, as shown in FIGS. 12(A) through 12(D).

The jig 70 comprises: a rod-like main body 71; a holder part 72 projecting beyond the end of the main body and holding the connector main body 31; a slide base 73 slidable in the $Y_1$ and $Y_2$ directions along the main body 71; a pair of arms 76 and 77 pivotally supported on the slide base 73 by means of pins 74 and 75.

The arms 76 and 77 hold clamp parts 76*a* and 77*a* at the end thereof and are pressed by a spring 78 in a direction in which a clamping force is exerted.

The cable 36 is drawn to a side; the jig 70 is inserted into the connector 30 from the side of the cable 36; the holder part 72 is engaged with the connector main body 31; and the ring 41*c* of the sliding member 41 is clamped by operating the arms 76 and 77.

A knob 73*a* at the end of the slide base 73 is operated in the $Y_1$ and $Y_2$ directions so as to move the sliding member 41.

As shown in FIGS. 12(A)–12(D), by using the jig 70, any of the connectors 30 closely arranged in a matrix can be pulled out smoothly even when there is only a small gap between the adjacent connectors 30.

A description will now be given, with reference to FIGS. 13 and 14, of another embodiment of the present invention.

In the figures, parts that correspond to the parts of FIGS. 4 and 8 are designated by the same reference numerals as in previous figures and the descriptions thereof are omitted.

As shown in FIG. 13, a second half-body 33A of a connector 30A has arms 33A$b_{-1}$ and 33A$b_{-2}$ lying on the side of the block 35.

Arc-like projections 33A$_{-1}$ and 33A$c_{-2}$ are provided at the end of the arms 33A$b_{-1}$ and 33A$b_{-2}$.

Figure 14:
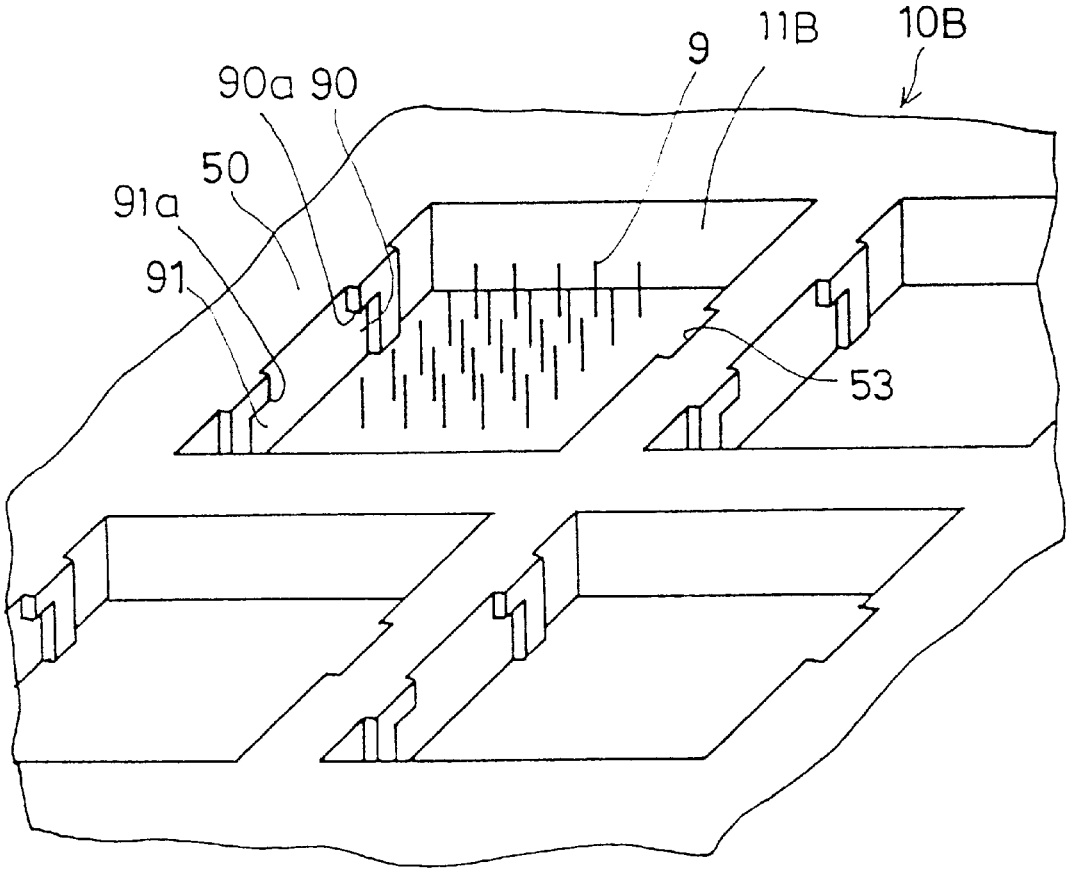
FIG. 14 shows a connector guide to which the connector of FIG. 10 is connected.

The connector 10B is configured as shown in FIG. 14.

The connection part 11B of the computer unit is configured such that a pair of L-shaped recess parts 90 and 91 are provided opposite each other in the wall 50 and serve as engaging parts.

As shown in FIG. 13, the connector 30A is connected to the connection part 11B provided in the connector guide 10B.

Projection parts 33A$c_{-1}$ and 33A$c_{-2}$ are fitted into recess parts 90 and 91, respectively. The sliding member 41 is advanced between the arms 33A$b_{-1}$ and 33A$b_{-2}$. The arms 33A$b_{-1}$ and 33A$b_{-2}$ are limited in their movement in the directions $X_1$ and $X_2$ and are prevented from closing a gap between each other. The stopper mechanism 40 is locked in this state.

As in the first embodiment, the connector 30A is pulled out by pulling, with a predetermined force, the sliding member 41 in the $Y_2$ direction.

Figure 15:
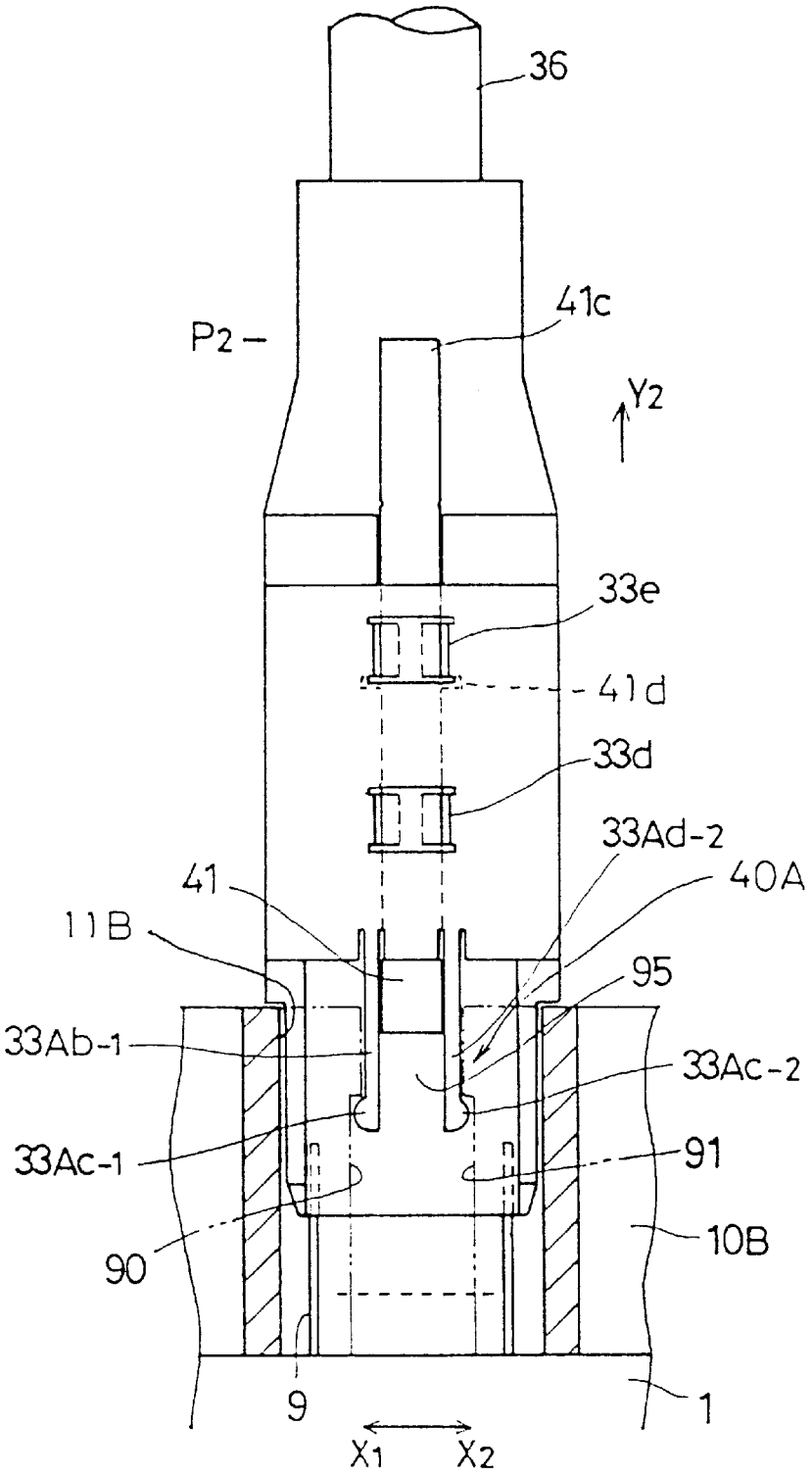
FIG. 15 shows a first step of pulling the connector of FIG. 14.

A first step of pulling out the connector 30A is as follows. As shown in FIG. 15, the sliding member 41 is removed from a position between the arm parts 33A$b_{-1}$ and 33A$b_{-2}$, thus leaving a space 95. The arm parts 33A$b_{-1}$ and 33A$b_{-2}$ are now free to be elastically displaced, and the stopper mechanism 40 is unlocked.

Subsequently, arc parts of the arc-like projection parts 33A$c_{-1}$ and 33A$c_{-2}$ are caused to slide upon shoulder parts 90*a* and 91*a* of the recess parts 90 and 91. A force exerted at this time causes the arm parts 33A$b_{-1}$ and 33A$b_{-2}$ to bend in a breadthwise direction of the connector 30 so as to close the gap between the parts. The projection parts 33A$c_{-1}$ and

Figure 16:
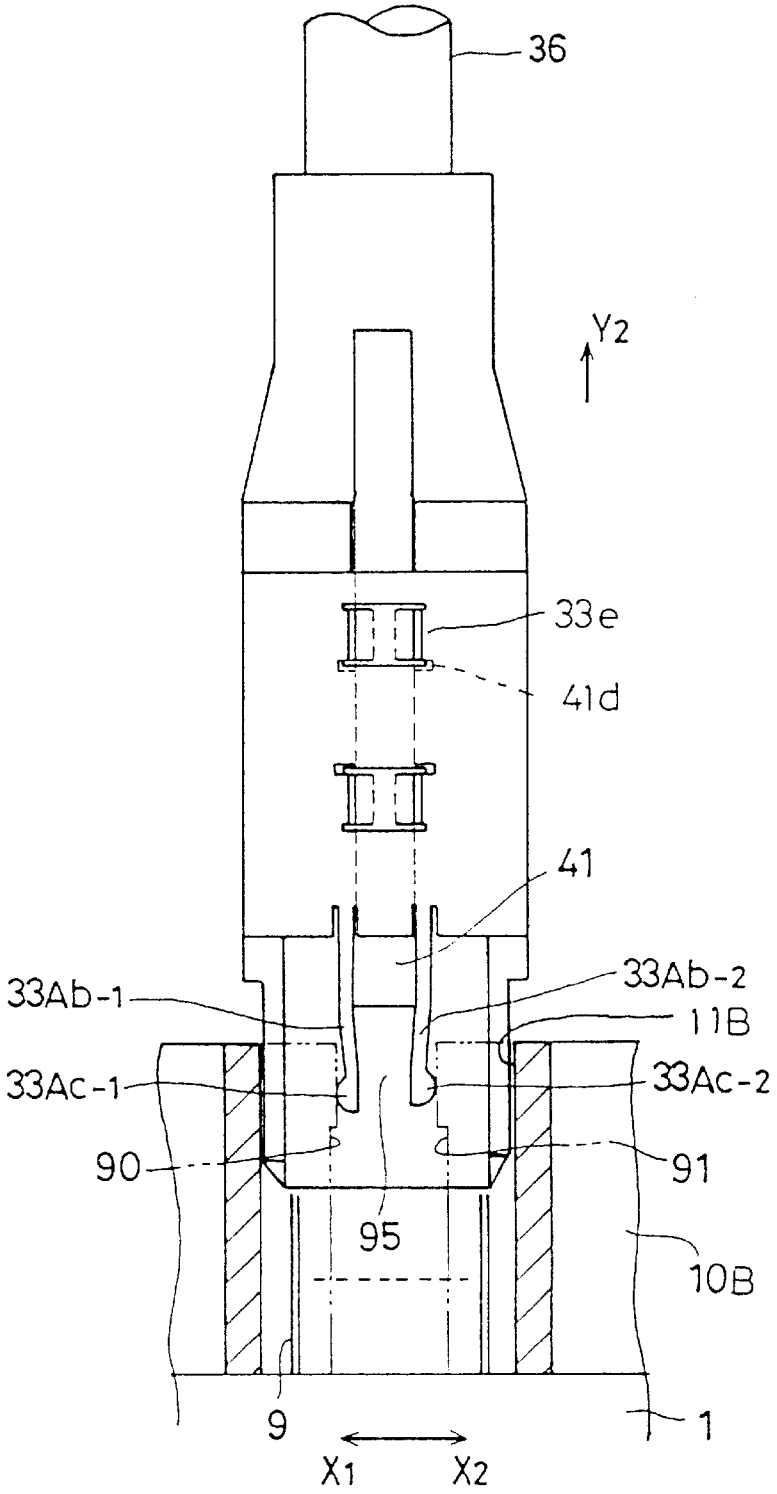
FIG. 16 shows a second step of pulling the connector of FIG. 14.

33A$c_{-2}$ are then pulled out of the recess parts 90 and 91, as shown in FIG. 16.

While the second cover half-bodies 33 and 33A in the above described embodiments are assumed to be made of a thin sheet metal, and the arm parts 33*b*, 33A$b_{-1}$ and 33A$b_{-2}$ are provided as parts of the first cover half-bodies 33 and 33A, the arm parts can be made separately from the second cover half-body and fixed to the connector main body.

According to the invention as claimed in claim 1, the stopper means can be made sufficiently thinner than the conventional one, thereby allowing the breadthwise dimension of the connector main body to be smaller than that of the conventional art and making the connector smaller in scale than the conventional one.

According to the invention as claimed in claim 2, the stopper means can be made thinner in an effective manner, thus making the connector smaller in scale in an effective manner and reducing the number of parts used.

According to the invention as claimed in claim 3, the stopper means can be unlocked and the connector can be pulled out of the connector of the computer unit merely by pulling the sliding member, thus ensuring an easy operation.

The present invention is not limited to the above described embodiments, and variations and modifications may be made without departing from the scope of the present invention.

We claim:

1. An electrical connector for connection with a printed circuit board of a computer unit, including a connector main body attached at an end of a cable, said connector comprises:

a resilient arm part integral with a wall of the connector main body;

a round projection part projecting from an end of said arm part and being operative to be resiliently urged into engagement with an engaging part of a cooperating connector of the computer unit when said connector main body is received in said computer unit;

a sliding member mounted in said wall of said connector main body for sliding movement between a first position in which said member is disposed to flank said arm part to prevent said projection part from being displaced from engagement with said engaging part, and a second position in which said member is removed from its flanking position with respect to said arm part to allow said projection part on said arm part to be displaced from engagement with said engaging part, said sliding member being movable between said first and second positions and having a portion extending through an opening in said wall of said connector main body for access on the exterior side of said wall;

grasping means on said sliding member for pulling and pushing said slide member between said first and said second position; and projection means extending outwardly from sides of said sliding member for limiting, by contacting a part of said wall of said connector main body cooperating with said projection means, the movement of said sliding member with respect to said connector main body as said sliding member is being pulled, whereby a pulling force imposed on said sliding member is transmitted through the contacting element to said connector main body for pulling the connector from said computer unit.

2. The electrical connector as recited in claim 1 in which said means on said sliding member for pulling and pushing it between said first and second positions has a ring shape permitting grasping of the sliding member.

* * * * *

UNITED STATES PATENT AND TRADEMARK OFFICE

CERTIFICATE OF CORRECTION

PATENT NO.: 5,951,316
DATED : September 14, 1999
INVENTOR(S): KAWANO et al.

It is certified that an error appears in the above-identified patent and that said Letters Patent is hereby corrected as shown below:

On the title page in item [73] change name of the second Assignee "Amadhl Corp." to be --Amdahl Corp.--.

Signed and Sealed this

Twenty-second Day of August, 2000

*Attest:*

Q. TODD DICKINSON

*Attesting Officer*

*Director of Patents and Trademarks*